US007562403B2

(12) United States Patent
Wei et al.

(10) Patent No.: US 7,562,403 B2
(45) Date of Patent: Jul. 21, 2009

(54) HOSPITAL BED APPARATUS FOR TURNING AND REPOSITIONING PLUS SHIFTING A PATIENT TO ANOTHER BED

(75) Inventors: Ching-Hua Wei, Yung-Kang (TW); Ting-Chun Tung, Yung-Kang (TW); Zhi-Hao Shi, Yung-Kang (TW); Whai-Shen Chen, Yung-Kang (TW); Shen-Yuan Lin, Yung-Kang (TW)

(73) Assignee: Southern Taiwan University of Technology, Tainan County (TW)

( * ) Notice: Subject to any disclaimer, the term of this patent is extended or adjusted under 35 U.S.C. 154(b) by 434 days.

(21) Appl. No.: 11/648,601

(22) Filed: Jan. 3, 2007

(65) Prior Publication Data

US 2007/0151025 A1 Jul. 5, 2007

(30) Foreign Application Priority Data

Jan. 4, 2006 (TW) ..... 95100259 A

(51) Int. Cl.
*A61G 7/14* (2006.01)

(52) U.S. Cl. ..... 5/81.1 R; 5/88.1; 5/83.1

(58) Field of Classification Search ..... 5/81.1 R, 5/83.1, 86.1–89.1
See application file for complete search history.

(56) References Cited

U.S. PATENT DOCUMENTS 2,208,410 A * 7/1940 Carter ..... 5/86.1
2,565,761 A * 8/1951 Dean ..... 5/86.1
3,302,219 A * 2/1967 Harris ..... 5/85.1
3,902,204 A * 9/1975 Lee ..... 5/86.1
4,502,169 A * 3/1985 Persson ..... 5/88.1
5,018,225 A * 5/1991 Fergni et al. ..... 5/607
5,054,140 A * 10/1991 Bingham et al. ..... 5/600
5,327,593 A * 7/1994 Burnett ..... 5/85.1
5,697,109 A * 12/1997 Hodgetts ..... 5/81.1 R

* cited by examiner

*Primary Examiner*—Michael Trettel
(74) *Attorney, Agent, or Firm*—Rosenberg, Klein & Lee

(57) ABSTRACT

A hospital bed apparatus includes a supporting frame, a lifting mechanism, and a horizontally moving mechanism; the lifting mechanism includes two horizontal rods on two sides of a hospital bed, and a sheet is disposed between and connected to the horizontal rods; either one of the horizontal rods can be lifted so as to turn and reposition the patient on the sheet; the horizontally moving mechanism includes linearly displaceable transverse rods, and connecting rods pivoted to the transverse rods and the lifting mechanism; the sheet and the horizontal rods of the lifting mechanism will be moved outside of the hospital bed when the horizontally moving mechanism is actuated after the sheet have been lifted off the hospital bed together with the horizontal rods; thus, the patient can be shifted to another hospital bed.

9 Claims, 6 Drawing Sheets

HOSPITAL BED APPARATUS FOR TURNING AND REPOSITIONING PLUS SHIFTING A PATIENT TO ANOTHER BED

BACKGROUND OF THE INVENTION

1. Field of the invention

The present invention relates to a hospital bed apparatus, more particularly one, which can be used to turn and reposition a patient on the hospital bed plus shift the patient from the currently used hospital bed to another, thus reducing discomfort resulting from lying on the hospital bed for a long length of time as well as reducing inconvenience resulting from manually shifting the patient.

2. Brief Description of the Prior Art

Those people who have to sit or lie in one position for a long length of time might get pressure sores, which are areas of injured skin and tissue. Sitting or lying in one position for too long puts pressure on certain areas of the body. The pressure can reduce the blood supply to the skin and the tissues under the skin. When a change in position doesn't occur often enough and the blood supply gets too low, a sore may form.

Severely disabled people such as those suffering from pathological change in central nervous system and severe stroke are prone to get pressure sores because they can't shift their position by themselves. Consequently, other persons have to shift the patients' position often so as to prevent the patients from getting pressure sores because of lying in one position for too long. Shifting a severely disabled patient's position would be a very difficult and strenuous task.

Furthermore, it is also relatively difficult and strenuous to shift a severely disabled patient from the hospital bed to another bed used with medical examination apparatuses when they have to be examined with the medical examination apparatuses such as tomography scanners, and magnetic resonance imaging devices (MRI). The patients and even the caregivers might get injured in such shifting if the caregivers fail to move and exert force properly.

Therefore, the medical apparatus industry developed various systems for shifting patients from a hospital bed to another, e.g. one with rails on the ceiling and hanging devices, a hanging and transporting apparatus, sheet moving systems for drawing and moving a sheet in horizontal direction, and air mattress moving systems for drawing and moving an air mattress in horizontal direction.

The above-mentioned systems can only shift a patient from one hospital bed to another, but they can't serve to turn and reposition a patient so as to prevent the patient from lying in one position for too long. Consequently, the caregivers still have to spend a lot of time and use a lot of strength to turn and reposition the patient manually, and there is still room for improvement in such systems.

SUMMARY OF THE INVENTION

It is a main object of the invention to provide an improvement on a hospital bed apparatus for turning and repositioning plus shifting a patient to another bed to overcome the above-mentioned problems. The hospital bed apparatus includes a supporting frame, a lifting mechanism, and a horizontally moving mechanism. The lifting mechanism includes two horizontal rods on two sides of a hospital bed, and a sheet is disposed between and connected to the horizontal rods. Either one of the horizontal rods can be lifted so as to turn and reposition the patient on the bed. The horizontally moving mechanism includes two linearly displaceable transverse supporting rods, and connecting rods are pivoted to the transverse supporting rods and the lifting mechanism. The sheet and the horizontal rods of the lifting mechanism will be moved outside of the hospital bed when the horizontally moving mechanism is actuated after the sheet together with the horizontal rods have been lifted off the hospital bed; thus, the patient can be shifted from the currently used hospital bed to another.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
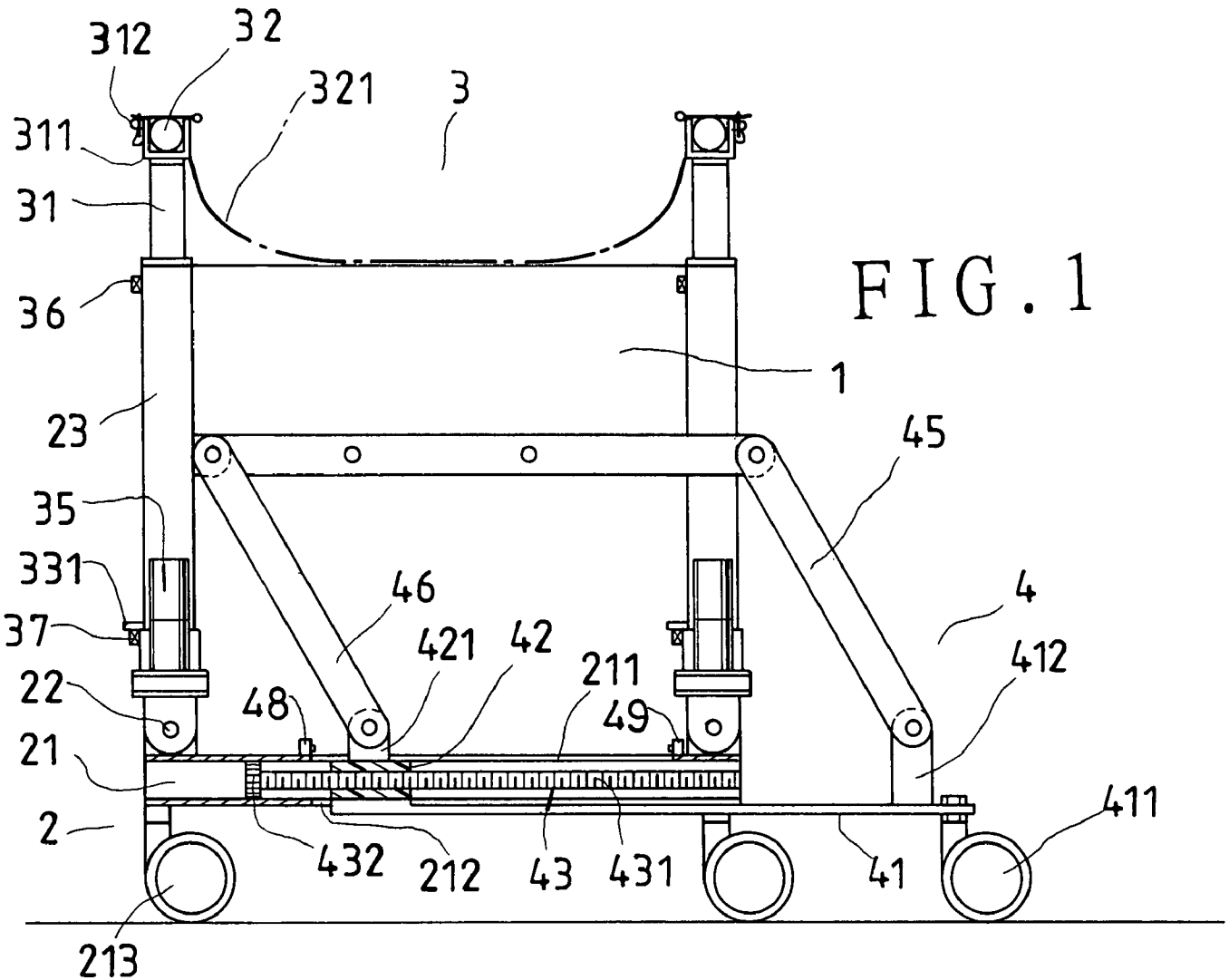
FIG. 1 is a side view of the present invention.
Figure 2:
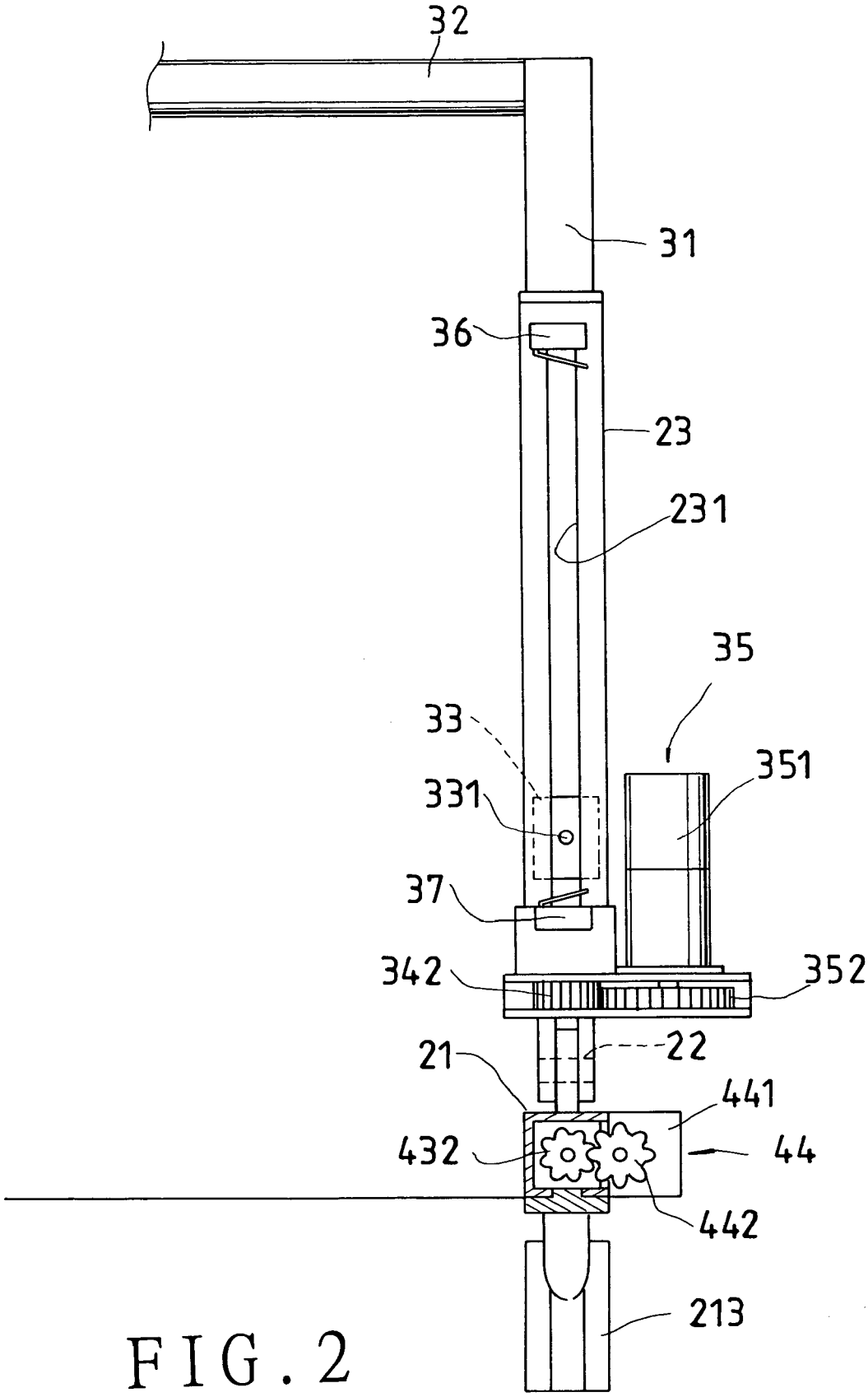
FIG. 2 is a partial front sectional view of the present invention.
Figure 3:
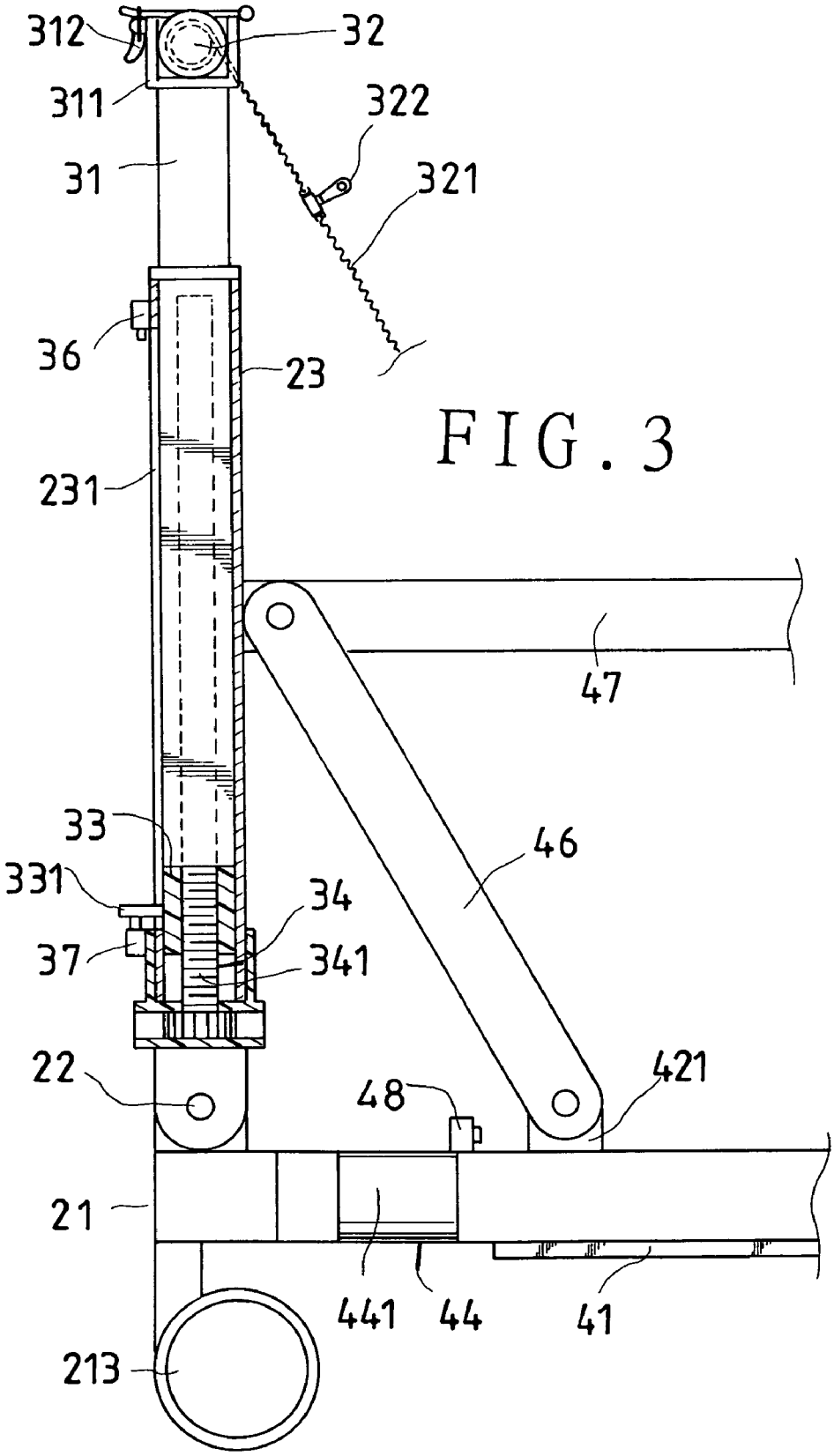
FIG. 3 is a partial lateral sectional view of the present invention.

Referring to FIGS. 1 to 3, a preferred embodiment of the present invention includes a supporting frame 2, a lifting mechanism 3, and a horizontally moving mechanism 4.

The supporting frame 2 is disposed outside of a hospital bed 1, and includes:

two transverse hollow rods 21, the transverse hollow rods 21 are fitted to front and rear ends of the hospital bed 1 respectively; each of the transverse hollow rods 21 has an upper lengthwise extending guide hole 211 on an upper side, and a lower lengthwise extending guide hole 212 on a lower side thereof; each of the transverse hollow rods 21 has casters 213 fitted on the lower side thereof; and hollow straight supporting rods 23, the hollow straight supporting rods 23 are each pivoted to a respective one of two ends of the upper sides of the transverse hollow rods 21 by means of a pivotal shaft 22; each of the hollow straight supporting rods 23 has a lengthwise extending guide hole 231 on an outward side thereof.

The lifting mechanism 3 includes:

Several supporting rods 31, each of the supporting rods 31 is passed into a respective one of the hollow straight supporting rods 23 of the supporting frame 2; each of the supporting rods 31 has a propping part 311 fitted on an upper end thereof, and a fastening element 312 fitted to each of the propping parts 311; each of the supporting rods 31 has a position limiting block 33 fitted to a lower end thereof; each of the position limiting block 33 has a pressing stick part 331, which sticks out through the lengthwise extending guide hole 231 of the corresponding hollow straight supporting rods 23 so as to press the upper micro-switch 36 and lower micro-switch 37;

two horizontal rods 32 on two sides of the hospital bed 1, the horizontal rods 32 are propped by the propping parts 311, and fastened to the propping parts 311 by means of the fastening elements 312 at two ends thereof;

a sheet 321 connected to the horizontal rods 32 at two sides thereof; the sheet 321 has zippers 322, and is connected to the horizontal rods 32 by means of the easy detached and secured fastener such as zippers 322;

transmission rods 34, each of the transmission rods 34 is passed through one of the position limiting block 33 and into the corresponding supporting rod 31;

power sources 35 fitted outside respective ones of the hollow straight supporting rods 23 of the supporting frame 2; the power sources 35 are provided for making the supporting rods 31 move up and down through the transmission rods 34; in the present preferred embodiment, each of the power sources 35 is a motor 351 with a gear 352 fitted thereto, and each of -the transmission rods 34 is a threaded rod 341 with a gear 342 being fitted thereon as well as engaged with the gear 352 of the corresponding motor 351; the power sources 35 engaged with transmission rods 34 can be replaced by oil hydraulic cylinders, air pressure cylinders or electric cylinders (not shown in the drawings); and upper and lower micro-switches 36 and 37, the upper micro-switches 36 are each fitted on an upper end of a respective said lengthwise extending guide hole 231 of the hollow straight supporting rods 23, and the lower micro-switches 37 are each fitted on a lower end of a respective said lengthwise extending guide hole 231; the pressing stick parts 331 of the position limiting block 33 stick out through the lengthwise extending guide holes 231 of the hollow straight supporting rods 23 so as to face the corresponding upper and lower micro-switches 36 and 37.

The horizontally moving mechanism 4 includes:

a transverse supporting rod 41 under each of the transverse hollow rods 21 of the supporting frame 2; each of the transverse supporting rods 41 has a caster 411 fitted an outward one end thereof, and a position limiting block 42 connected to an inward end thereof, which position limiting block 42 is passed through the lower lengthwise extending guide hole 212 of the corresponding transverse hollow rod 21 of the supporting frame 2; each of the transverse supporting rods 41 has a pivotal protrusion 412 on an outward end thereof; each of the position limiting block 42 has a pivotal protrusion 421 on an upper end thereof, which pivotal protrusion 421 sticks out through the upper lengthwise extending guide hole 211 of the corresponding transverse hollow rod 21;

a transverse transmission rod 43 held in each of the transverse hollow rods 21 of the supporting frame 2, the transverse transmission rods 43 are passed through the position limiting block 42 respectively;

a power source 44 fitted outside each of the transverse hollow rods 21 of the supporting frame 2, the power sources 44 are provided for causing inward and outward linear displacement of the corresponding transverse supporting rods 41 and position limiting block 42 through the transverse transmission rods 43;

a connecting rod 45 pivoted at a lower end to each of the pivotal protrusions 412 of the transverse supporting rods 41; and a connecting rod 46 pivoted at a lower end to each of the pivotal protrusions 421 of the position limiting block 42; the connecting rods 45 and 46 are pivoted to the corresponding hollow straight supporting rods 23 of the supporting frame 2 at upper ends thereof, and every two adjacent connecting rods 45 and 46 are connected together at the upper ends by means of a co-moving rod 47.

left and right micro-switches 48 and 49, the left and right micro-switches 48 and 49 are separately fitted on both ends of said upper lengthwise extending guide hole 211 of the transverse hollow rod 21.

In the present preferred embodiment, each of the power sources 44 is a motor 441 with a gear 442 fitted thereto, and each of the transverse transmission rods 43 is a threaded rod 431 with a gear 432 being fitted thereon as well as engaged with the gear 442 of the corresponding motor 441; the power sources 44 engaged with transverse transmission rods 43 can be replaced by oil hydraulic cylinders, air pressure cylinders or electric cylinders (not shown).

Figure 4:
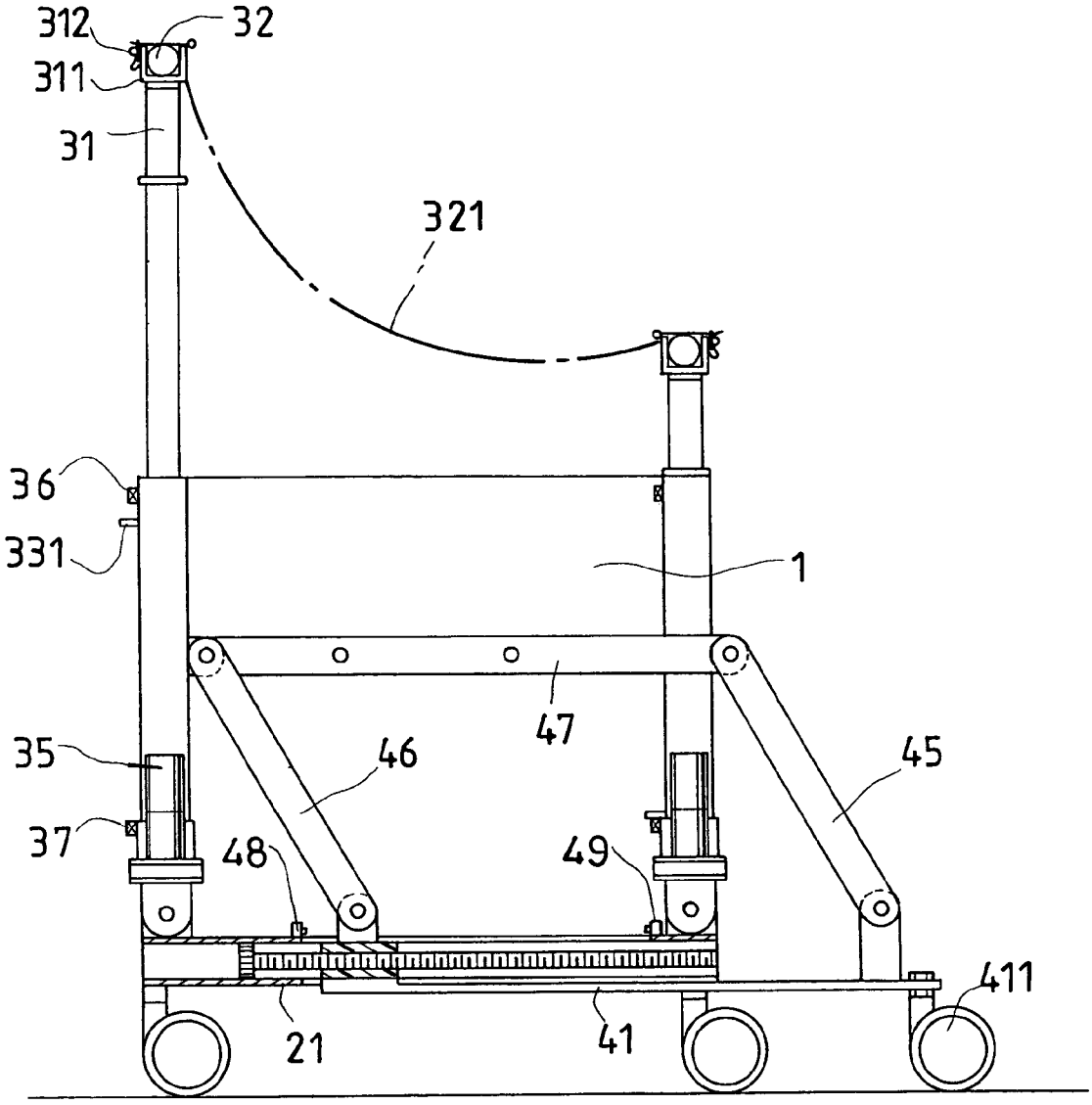
FIG. 4 is a side view of the present invention, taken when the turning and repositioning function is used.

The sheet 321 connected to the horizontal rods 32 of the lifting mechanism 3 will be in touch with and supported on the hospital bed 1 under a normal condition. Referring to FIG. 4, a patient can be turned and repositioned by means of actuating those of the power sources 35 that are one side of the hospital bed 1 for said power sources 35 to lift the corresponding transmission rods 34, the position limiting block 33 and the supporting rods 31; when the position limiting block 33 are lifted to their highest position, the pressing stick parts 331 thereof will press the upper micro-switches 36 so as to stop the power sources 35; when the position limiting block 33 are moved to their lowermost position, the pressing stick parts 331 thereof will press the lower micro-switches 37 so as to stop the power sources 35, thus making the apparatus of the present invention safe to use. In the same principle, when the pivotal protrusion 421 of the position limiting block 42 moves to a certain position in left and right directions to press the left and right micro-switches 48 and 49, the power source 44 can be stopped to make the apparatus of the present invention safe to use; thus, the corresponding horizontal rod 32 and the corresponding side of the sheet 321 will be lifted together with said position limiting block 33 and supporting rods 31 such that the patient is turned and repositioned to one side on the hospital bed 1, allowing other persons such as nurses and caregivers to turn and reposition the patient with ease.

Figure 5:
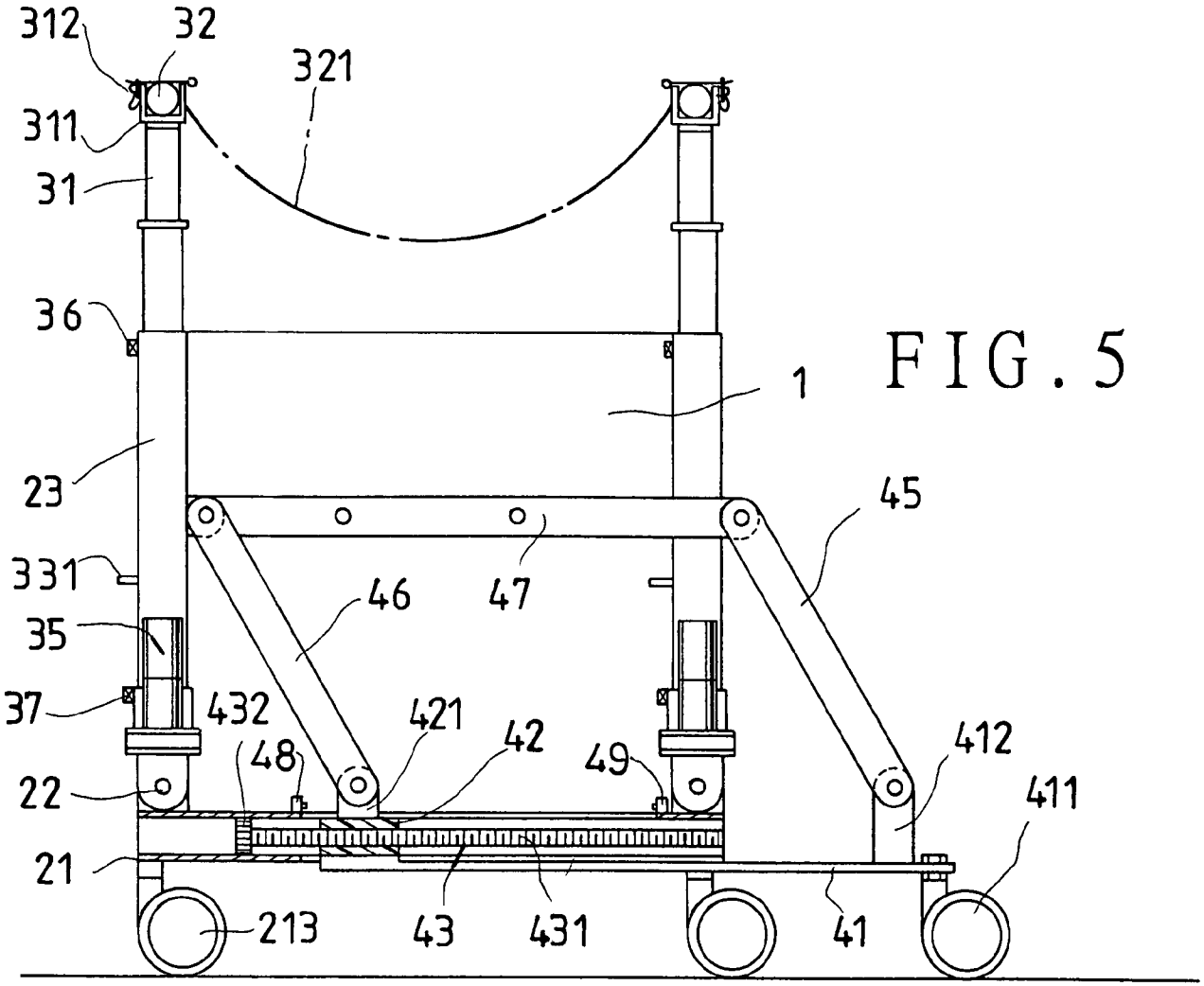
FIG. 5 is a side view of the present invention, taken when the shifting function is used (1)
Figure 6:
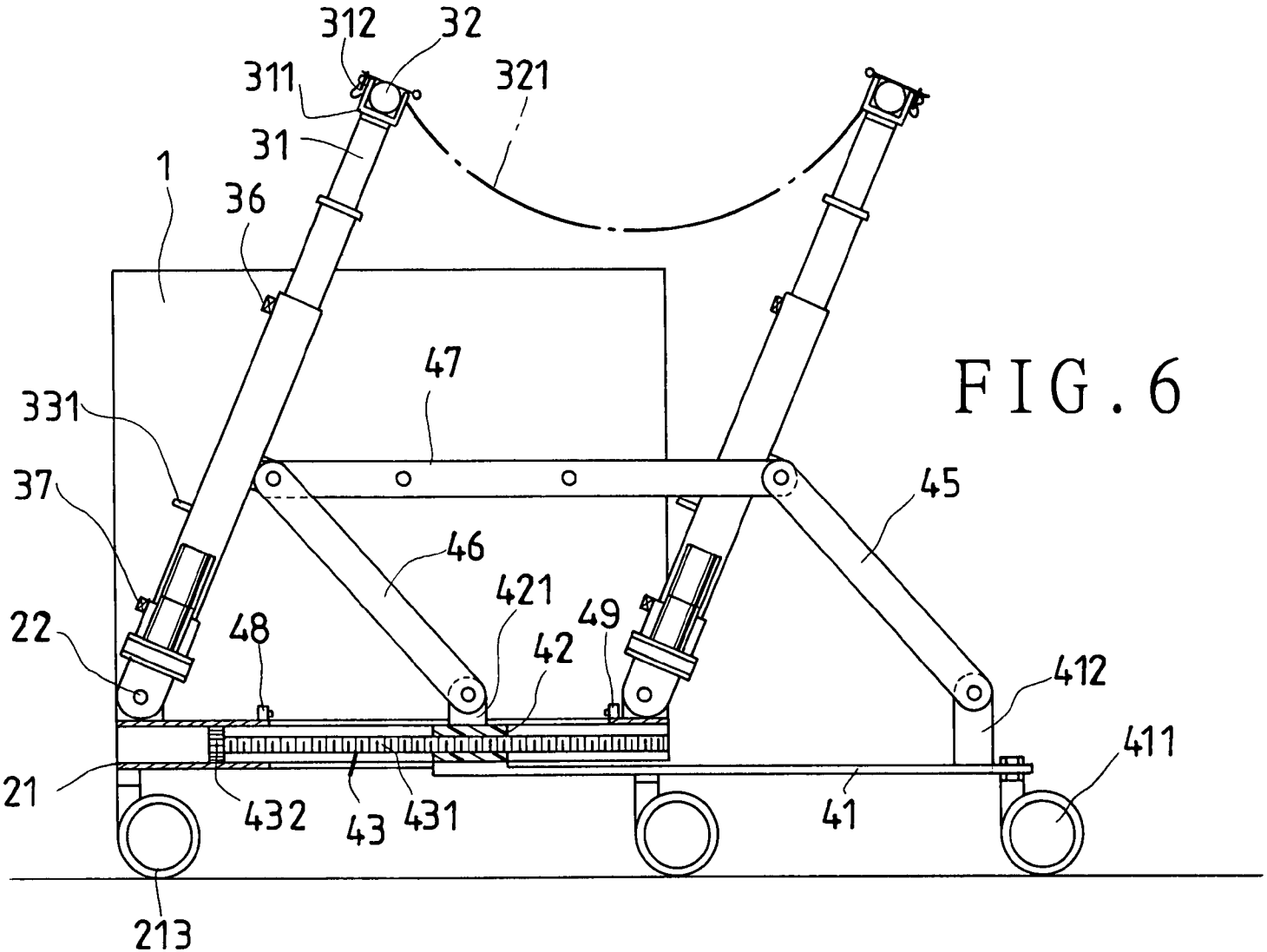
FIG. 6 is a side view of the present invention, taken when the shifting function is used (2).

Referring to FIGS. 5 and 6, the patient can be shifted from the currently used hospital bed 1 to another with the help of the apparatus of the present invention. First, the power sources 35 of the lifting mechanism 3 are actuated so as to lift the transmission rods 34, the position limiting block 33 and the supporting rods 31; thus, the patient together with the sheet 321 are lifted off the hospital bed 1. Next, the power sources 44 of the horizontally moving mechanism 4 are actuated for the power sources 44 to move the position limiting block 42 together with the transverse supporting rods 41 outwards through the horizontal transmission rods 43; thus, the connecting rods 45 and 46 will pivot outwards relative to the transverse supporting rods 41, and at the same time the hollow straight supporting rods 23 will also pivot outwards relative to the transverse supporting rods 41, from an upright position to a tilting position. Consequently, the sheet 321 is moved outwards together with the horizontal rods 32, thus capable of being repositioned to right above another bed.

Furthermore, the sheet 321 together with the horizontal rods 32 can be manually shifted to another bed after the fastening elements 312 are opened so as to allow the horizontal rods 32, which are currently propped by the propping parts 311 of the supporting rods 31, to be lifted off the propping parts 311. And, the sheet 321 together with the horizontal rods 32 can serve as a stretcher after they are separated from the supporting rods 31.

From the above description, it can be seen that the apparatus of the present invention has the following advantages: the apparatus can turn and reposition the patient so as to reduce the discomfort resulting from lying on the hospital bed for a long length of time; the apparatus can be used to shift the patient from the hospital bed to another, thus reducing the inconvenience resulting from manually shifting the patient.

What is claimed is:

1. A hospital bed apparatus for turning and repositioning plus shifting a patient, comprising (a) a supporting frame positioned outside of a hospital bed, the supporting frame including:

two transverse hollow rods fitted on front and rear ends of the hospital bed respectively; the transverse hollow rods each having an upper and a lower lengthwise extending guide holes; and hollow straight supporting rods, the hollow straight supporting rods being pivoted to two ends of upper sides of the transverse hollow rods by means of pivotal shafts; the hollow straight supporting rods each having a lengthwise extending guide hole on an outward side thereof.

(b) a lifting mechanism, including:

supporting rods passed into respective ones of the upright hollow rods of the supporting frame; the supporting rods each having a position limiting block joined to a lower end thereof;

two horizontal rods arranged on respective ones of two sides of the hospital bed, the horizontal rods being connected to and propped by upper ends of the hollow straight supporting rods of the supporting frame; a sheet being disposed between and connected to the horizontal rods at two sides thereof;

transmission rods each passed through a corresponding said position limiting block and into a corresponding said supporting rod; and power sources disposed outside respective said straight supporting rods of the supporting frame for making the supporting rods move up and down through the transmission rods; and (c) a horizontally moving mechanism, including:

transverse supporting rods under respective said transverse hollow rods of the supporting frame; the transverse supporting rods each having a caster fitted an outward one end thereof; the transverse supporting rods each having a position limiting block connected to an inward end thereof and passed through the lower lengthwise extending guide hole of a corresponding said transverse hollow rod of the supporting frame; the transverse supporting rods each having a first pivotal protrusion on an outward end thereof; the position limiting block each having a second pivotal protrusion on an upper end thereof, which second pivotal protrusion sticks out through the upper lengthwise extending guide hole of a corresponding said transverse hollow rod of the supporting frame;

transverse transmission rods held in respective said transverse hollow rods of the supporting frame, the transverse transmission rods being passed through corresponding said position limiting bars;

power sources disposed outside of respective said transverse hollow rods of the supporting frame for causing inward and outward linear displacement of the transverse supporting rods and the position limiting block through the transverse transmission rods;

first connecting rods pivoted to respective said first pivotal protrusions of the transverse supporting rods; and second connecting rod pivoted to respective said second pivotal protrusions of the position limiting block;

the first and the second connecting rods being pivoted to respective said hollow straight supporting rods of the supporting frame at other ends thereof; every two adjacent said first and said second connecting rods having a co-moving rod positioned in between and connected thereto.

2. The hospital bed apparatus for turning and repositioning plus shifting a patient as recited in claim 1, wherein the lifting mechanism further includes upper and lower micro-switches, the upper micro-switches are each fitted on an upper end of a respective said lengthwise extending guide hole of the hollow straight supporting rods, and the lower micro-switches are each fitted on a lower end of a respective said lengthwise extending guide hole, and the position limiting block each has a pressing stick part thereon, which sticks through a corresponding said lengthwise extending guide hole of the hollow straight supporting rods so as to face corresponding said upper and lower micro-switches; when the supporting rods of the lifting mechanism are lifted to a highest position, the pressing stick parts of the position limiting bars will press the upper micro-switches to stop the power sources; when the supporting rods are moved to a lowermost position, the pressing stick parts will press the lower micro-switches to stop the power sources.

3. The hospital bed apparatus for turning and repositioning plus shifting a patient as recited in claim 1, wherein the power sources of the lifting mechanism and the horizontally moving mechanism are each a motor with a gear fitted thereto, and the gears are engaged with the gears on the threaded rods for passing on motion of the motors.

4. The hospital bed apparatus for turning and repositioning plus shifting a patient as recited in claim 1, wherein the power sources are oil hydraulic cylinders.

5. The hospital bed apparatus for turning and repositioning plus shifting a patient as recited in claim 1, wherein the power sources are air pressure cylinders.

6. The hospital bed apparatus for turning and repositioning plus shifting a patient as recited in claim 1, wherein the power sources are electric cylinders.

7. The hospital bed apparatus for turning and repositioning plus shifting a patient as recited in claim 1, wherein the sheet is connected to the horizontal rods of the lifting mechanism by means of zippers.

8. The hospital bed apparatus for turning and repositioning plus shifting a patient as recited in claim 1, wherein each of the supporting rods of the lifting mechanism has a propping part fitted on an upper end thereof for holding the horizontal rods, and a fastening element fitted to each of the propping parts for fastening the horizontal rods; the sheet together with the horizontal rods can serve as a stretcher after they are separated from the supporting rods.

9. The hospital bed apparatus for turning and repositioning plus shifting a patient as recited in claim 1, wherein the horizontally moving mechanism further includes left and right micro-switches, the left and right micro-switches are separately fitted on both ends of said upper lengthwise extending guide hole of the transverse hollow rod, corresponding to the pivotal protrusion; when the pivotal protrusion of the position limiting block moves to a certain position in left and right directions to press the left and right micro-switches, the power source can be stopped to make the apparatus of the present invention safe to use.

* * * * *